US005140715A

United States Patent [19]

Monacelli

[11] Patent Number: 5,140,715

[45] Date of Patent: Aug. 25, 1992

[54] METHOD AND APPARATUS FOR PRODUCING ASSEMBLIES OF HEADED FASTENERS

[76] Inventor: Umberto Monacelli, via Parini 6, I-20052 Monza, Italy

[21] Appl. No.: 699,418

[22] Filed: May 13, 1991

[51] Int. Cl.[5] ..... B21G 3/26; B21G 3/20

[52] U.S. Cl. ..... 470/40; 470/128

[58] Field of Search ..... 10/28, 30, 31, 34, 35, 10/53, 54, 61, 70, 42, 43, 44; 411/442, 443

[56] References Cited

U.S. PATENT DOCUMENTS

| | | |
|---|---|---|
| 3,083,369 | 4/1963 | Peterson . |
| 3,095,588 | 7/1963 | Haubold . |
| 3,234,572 | 2/1966 | Roser . |
| 3,276,576 | 10/1966 | Langas et al. . |
| 3,315,436 | 4/1967 | Baum et al. . |
| 3,432,985 | 3/1969 | Halstead . |
| 3,463,304 | 8/1969 | Gallee et al. . |
| 3,604,034 | 9/1971 | Leistner . |
| 3,736,198 | 5/1973 | Leistner . |
| 4,343,579 | 8/1982 | Shelton et al. . |
| 4,409,461 | 10/1983 | Mizutani . |
| 4,532,399 | 7/1985 | Jones . |
| 4,640,164 | 2/1987 | Pavlov . |
| 4,679,975 | 7/1987 | Leistner . |
| 4,804,088 | 2/1989 | MacDonald . |

*Primary Examiner*—Lowell A. Larson
*Assistant Examiner*—Michael J. McKeon
*Attorney, Agent, or Firm*—Welsh & Katz, Ltd.

[57] ABSTRACT

An apparatus and a process for continuously producing an assembly of headed fasteners of uniform length. The fasteners, fixed in either an equally spaced apart parallel relationship or in a contiguous parallel relationship, are produced by providing at least one strand of wire in straight and untwisted form, cutting the wire into headless fasteners of uniform length, transferring the headless fasteners onto a guide track in parallel, adjacent alignment, collating the headless fasteners to form a continuous web thereof, conveying the continuous web of headless fasteners into a clamping block and then forming a head from one end of the fasteners to form the headed fastener. The apparatus for producing the headed fastener assembly includes means for providing the wire in straight untwisted form, means for cutting the wire into headless fasteners, means for transferring the headless fasteners onto a guide track in parallel adjacent alignment, means for collating the fasteners a conveyor to convey the continuous web of headless fasteners to a head-forming means, and severing means for selectively cutting the continuous web to produce the assemblies or clips of headed fasteners.

21 Claims, 11 Drawing Sheets

METHOD AND APPARATUS FOR PRODUCING ASSEMBLIES OF HEADED FASTENERS

BACKGROUND OF THE INVENTION

1. Field of the Invention

The present invention relates to fastener strips or assemblies. More particularly, the present invention is directed to an apparatus and a method for producing assemblies of headed fasteners fixed in an aligned relationship.

2. Background of the Invention

With the advent of rapid action fastener driving tools, it has become desirable to reduce the loading time of the tools and to have an assembly of fasteners in either strip or coiled form to be used in the magazines of such tools. The shape of the fastener and also that of the assembly of fasteners may vary considerably. Each fastener of the assembly of fasteners typically has a driver striking end, a shank and a workpiece entering end. The workpiece entering end of each fastener may be formed as a round, diamond, chisel or blunt point. The shanks ar the elongated portions connecting the driver striking end to the workpiece entering end and are fixed in a parallel relationship to one another. The driver striking end of each fastener may be the same shape as the shank or may be deformed to provide a "headed" portion.

Customarily, the term "headed" is used to distinguish a fastener that has the driver striking end deformed from a fastener that does not have the driver striking end deformed and is commonly known as a "pin". The head of the fastener may be formed in various shapes, some of which are "T" shaped, offset, moon-shaped, half-round and full round. The full round head, normally, has a diameter at least twice that of the shank and is generally known as a "common nail". Although the odd-shaped heads allow the fasteners to be assembled with the shank portions adjacent and thereby provide more fasteners in a given space, the user ordinarily prefers the full round head nail for normal fastening applications because of the greater holding power. For example, when two pieces of material are fastened together they are kept from separating by the ability of the shank to grip the lower piece of material and of the head to resist being pulled through the upper piece of material. Because the full round heads have a larger surface area than that of the other common shapes, the holding power is greater with all other conditions being equal.

The normal method of assembling round head nails is to first manufacture the nail on a nail producing device and then store the nails produced in bins. The nails are then taken from the bins and placed in a track to align the shanks in a parallel relationship with all of the heads in the same direction. The aligned nails are then transferred from the track into a third device that separates the shanks to a predetermined, spaced-apart distance and then bonds them together with a collating material. The assembled strip of nails is then cut into desired lengths and either left in assembly form or wound into coils. The type of collating material utilized will determine if the assembly of nails can be wound into coils. A few types of materials used for collating are paper and glue, molded plastic, wire welded to shanks, preformed plastic bands, and perforated steel strips.

This method of assembly, or some variation thereof, provides an acceptable finished product but the cost and size of the equipment is considerable. Furthermore, if the time between the forming and collating of the nails requires the nails to be stored, they may have to be cleaned before collating to assure an adequate bond. This, of course, will add to both the cost of manufacture and the amount of space required in the manufacture of the fastener strip.

Another disadvantage of the heretofore known method of assembling fastener strips is of the possibility of intermixing nail sizes and lengths. To change from one size nail to another size nail, all of the nails in the system must be used or else the uncollated nails must be removed from the equipment. Although care is normally taken during the changeover or in the addition of nails to the system during the normal production of the strip of nails, inadvertently, some nails may become mixed. The intermixing of different size nails will result in a defective product or machine downtime to clear the odd size nails from the equipment.

Some fastening applications require that the size of the head of the nail is small when the holding power of the nail is not important. These applications include the finish trim around windows and doors as well as the use of other decorative types of materials. Since the head can be small, the most common type of fastener is one having a T-shaped head. This term identifies a head that is in one direction the same thickness as the shank, while larger in the opposite direction. The T-shaped head allows the shank portions to be collated adjacent one another by a different method than the previously described method used for the full round head nail.

A selected number of wires may typically be laid adjacent to one another and then bonded together by glue, or the like, to form a band or web of wires. Next, the web is cut into clips or assemblies of a desired fastener length or number of wires. The assemblies are then held tightly in a clamp-like device while a punch strikes the clip along one of the cut edges. The end of each wire deforms into a rectangular shape with the smaller dimension being the same size as the diameter of the wire. The finished product is a fairly rigid assembly of T-shaped nails also known as brads, such as that described in U.S. Pat. No. 3,095,588. Another method of producing the T-shaped head is to form the head on the end of the band first, and then cut the band to the desired length to form the assembly of brads. The brads produced by either method are then driven from a tool with a magazine adapted to accommodate such an assembly. One of the biggest disadvantages in this method of producing fasteners is the number of fasteners in the clip or assembly is limited to the number of wires to make the clip. Another disadvantage is that as the number of wires to be headed in a single stroke is increased, the size of the heading equipment becomes very large.

Another method of producing an assembly of T-shaped nails is to produce the nail first and then align the nails in a fashion identical to that described for the round head nails. Normally, this method is used for the larger T-shaped nails because the adjacent alignment of smaller sized heads is more difficult after the nail is formed. Therefore, for the smaller sized T-shaped nails formation of the head after the clip has been assembled is preferable.

An object of the present invention is to provide an improved method of producing an assembly of fasteners in a continuous process from at least one strand of wire.

Another object of the invention is to provide a method of forming a variety of different head types of the fastener after the shank portions have been aligned and bonded together to form an assembly of headed fasteners.

A further object of the present invention is to provide an assembly of fasteners arranged in an aligned fashion such that each shank is of a uniform length.

Still a further object of the present invention is to provide a method of forming an assembly of fasteners arranged in a spaced apart fashion such that the length of the individual fastener may be varied with minimum cost and loss of production time.

SUMMARY OF THE INVENTION

In accordance with this invention, the objects and advantages of this invention are achieved by producing a continuous web of headless fasteners comprising a plurality of individual fasteners of uniform length and fixed in a parallel relationship. The individual headless fasteners of the web are positioned in an aligned relationship or in an equally spaced apart parallel relationship. Each headless fastener of the web is machined to provide a driver striking end deformed to form a headed fastener with increased holding power. The web of headed fasteners is then severed to provide assemblies of a selected number of fasteners or length.

The improved assemblies of fasteners are generally continuously produced by first forming individual headless fasteners. Each headless fastener is made by providing at least one strand of wire between a pair of wire straightening guides and then between a pair of feed wheels. As the feed wheels rotate, the feed wheels grip the wire or wires and pull the wire or wires through the straightening guides. Then the strand and/or strands of straightened wire are cut into the individual headless fasteners of uniform length and transferred onto a collating track. The collating track positions the headless fasteners into parallel alignment. Next, the aligned headless fasteners are collated along the collating track to form a continuous web of such headless fasteners. After the continuous web of headless fasteners is formed, the web is conveyed to a clamping device. At least one portion of the clamping device is movable to allow a section of the web of headless fasteners within the clamping device and to forcibly hold the section of headless fasteners there between. A head is then formed from an end of the section of fasteners contained within the clamping device by a reciprocal ram. The reciprocal ram is of a shape and size capable of deforming at least one and preferably two or more of the fastener ends for each reciprocal cycle of the ram. After the fasteners are headed they are ejected from between the clamping device and then the continuous web of headed fasteners is severed to provide assemblies of a selected length or a number of headed fasteners.

The apparatus for producing the improved assemblies of fasteners generally comprises several devices that cooperatively produce the improved fastener assemblies. In particular, the apparatus comprises a device for producing headless fasteners by providing at least one strand of wire in a straight and untwisted form, a device for cutting the strand or strands of wire into individual headless fasteners of uniform length after the wire is straightened, a device for transferring the headless fasteners into parallel alignment onto a collating track at a first workstation, a device for collating the headless fasteners so that the collating material is applied intermediate the ends of the headless fasteners to form a continuous web of headless fasteners, a conveyor device for conveying the continuous web of headless fasteners to a clamping device disposed at a second workstation, at least one portion of the clamping device is movable to receive a section of the web of headless fasteners within the clamping device and to forcibly hold the section of headless fasteners therebetween, a head-forming device for forming a head from one end of the fasteners as a portion of the continuous web of fasteners is held within the clamping device. The head-forming device being of a size and shape capable of forming at least one and preferably two or more heads from the fastener ends for each reciprocal cycle of the head-forming device. In yet another embodiment of the invention, the fastener producing apparatus includes a device for severing the continuous web of headed fasteners at a selected length after the fasteners are ejected from between the clamping device.

BRIEF DESCRIPTION OF THE DRAWINGS

These and other objects of this invention will be seen from the description and accompanying drawings, in which.

DESCRIPTION OF THE PREFERRED EMBODIMENT

Figure 1:
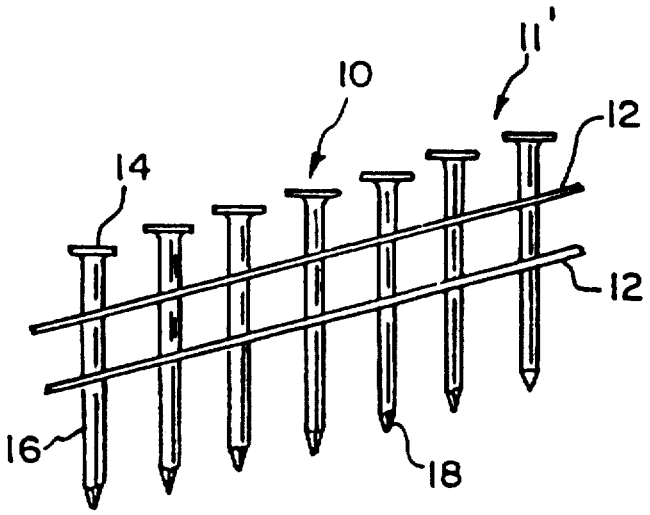
FIG. 1 is a perspective view of a fastener assembly comprised of parallel angled fasteners with a round head welded to two parallel strands of wire.
Figure 2:
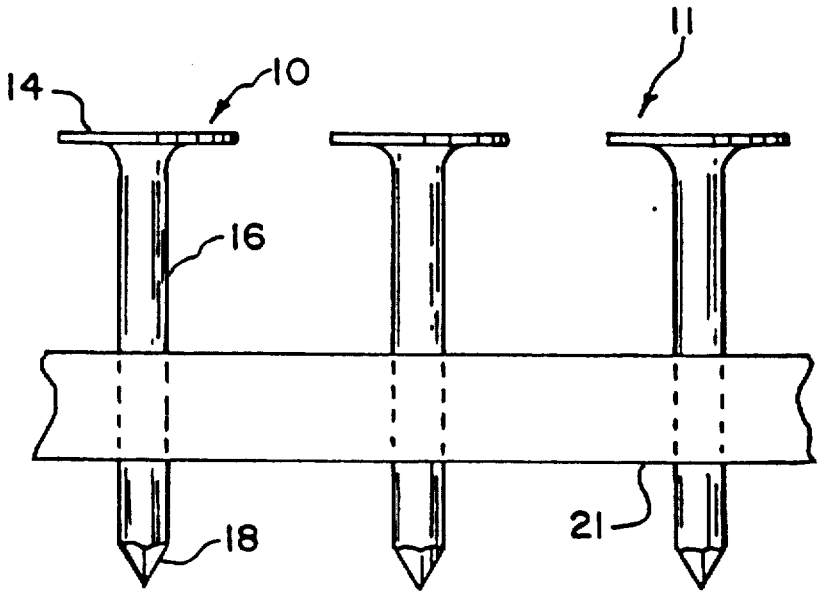
FIG. 2 is a perspective view of the fastener assembly comprised of headed fasteners fixed with a plastic strip.

Referring now to the drawings wherein like reference characters represent like elements, FIGS. 1-2 illustrate two different embodiments of fastener assemblies 11 produced in accordance with the present invention. The assemblies 11 of headed fasteners 10 produced in accordance with the present invention generally comprise a series of headed fasteners 10 fixed in a parallel relationship. The fasteners 10 are a parallel relationship by the use of a collating material 12, 21.

Each headed fastener of the various assemblies 11 and 11' of fasteners comprises a driver striking end or a head 14, a shank 16 and a workpiece entering end 18. The head 14 may either be offset, moon-shaped, half-round or full round. The head 14 of the fastener imparts the holding power to the fastener 10 after the fastener has entered its workpiece. The shank 16 is the long body portion of the fastener 10, connecting the head 14 of the fastener 10 and the workpiece entering end 18. The shank 16 is normally of circular cross section but may be of any cross-sectional shape identical to the cross-sectional shape of the strand of wire induced by the feed wheels from which the shank is formed. It will be appreciated that to increase the holding power of headed fasteners, the shank surface may be deformed by notching or roughened. The deformation may occur prior to use or may be done by the wire feeding means 38, 114 during the practice of the present invention as to be more fully described herein. The workpiece entering end 18 of the headed fastener 10 is formed as a round, diamond, chisel or blunt point and facilitates in the ease of entry of the fastener as the fastener enters the workpiece.

The collating material 12, as illustrated in FIG. 1, is comprised of at least one strand of wire welded to the shank 16 of each fastener to fix the fasteners in a spaced-apart parallel relationship to form an assembly 11 of headed fasteners 10. In FIG. 2, an alternative embodiment of the collating material utilized in the assembly 11 of fasteners is disclosed. In the alternative embodiment, the fasteners 10 are fixed in a parallel relationship by the use of a plastic strip 21 applied to at least on side of the shank 16 of each headed fastener 10.

The device for producing the fasteners of the present invention as illustrated in FIGS. 3, 4, 5 and 7 generally comprises a headless fastener producing means 22, a transferring means 23, 123, a collating means 24, a conveying means or device 25, a head-forming means 26, and a severing means 27.

The headless fastener producing means 22 of the present invention is illustrated in FIGS. 3, 4, 5 and 6. The headless fastener producing means 22 is typically driven by an electric motor 30 through a gear train (not shown). The gear train and electric motor are mounted on a vertical support frame 32, 132.

It will be appreciated that the present invention may include the use of more than one strand of wire 34. Multistrand feeding and cutting is well known in the art and has been used for producing fasteners such as staples and pins. The multiple strands of wire may be provided to the feeding means 114 and headless fastener producing means 22 designed for multistrand feeding and cutting. Unless otherwise indicated, as used herein the term "wire" is to be interpreted as including one or more strands of wire.

Figure 3:
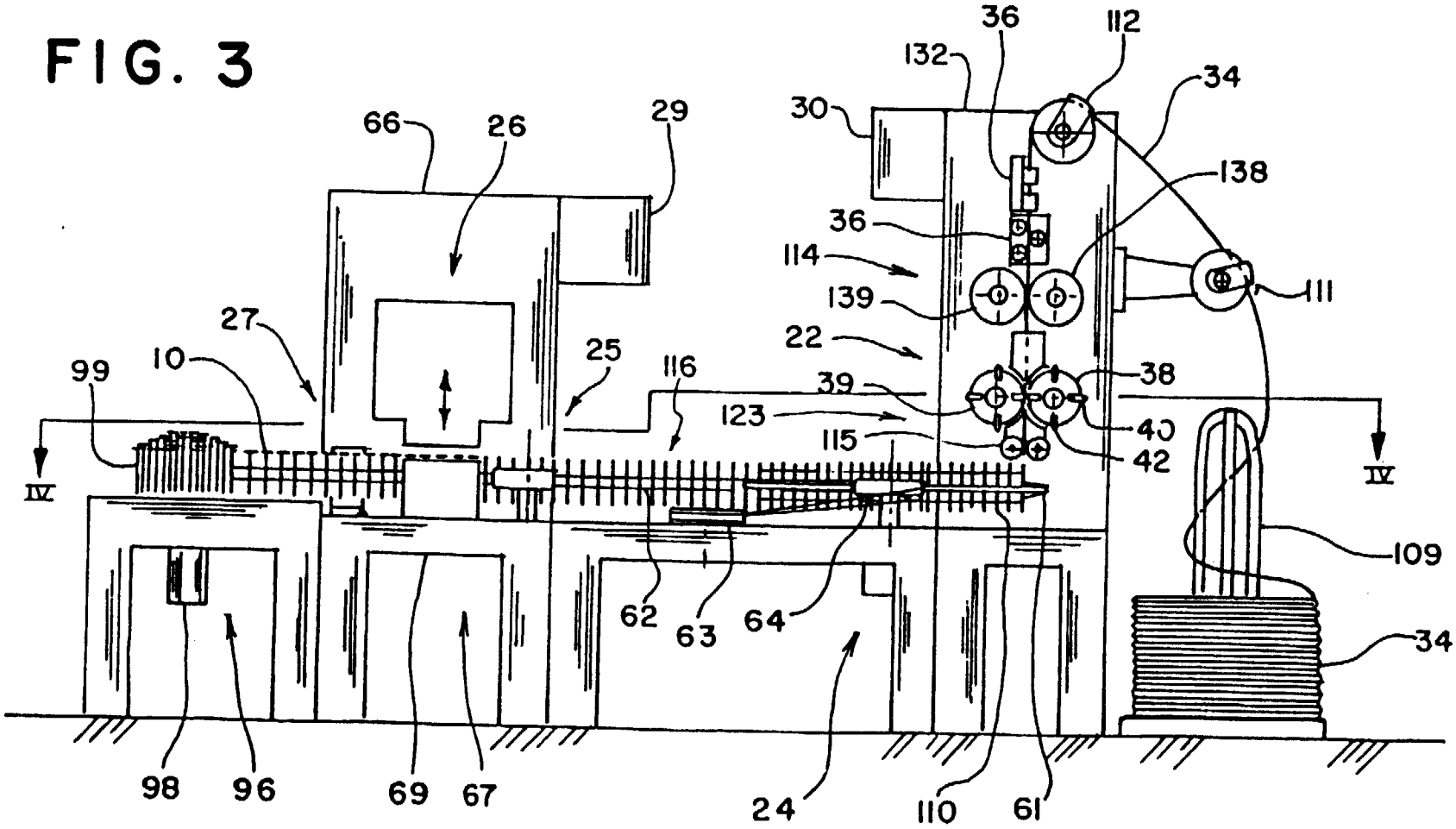
FIG. 3 is a side elevation view of the apparatus used to form the assemblies of fasteners according to the present invention.
Figure 4:
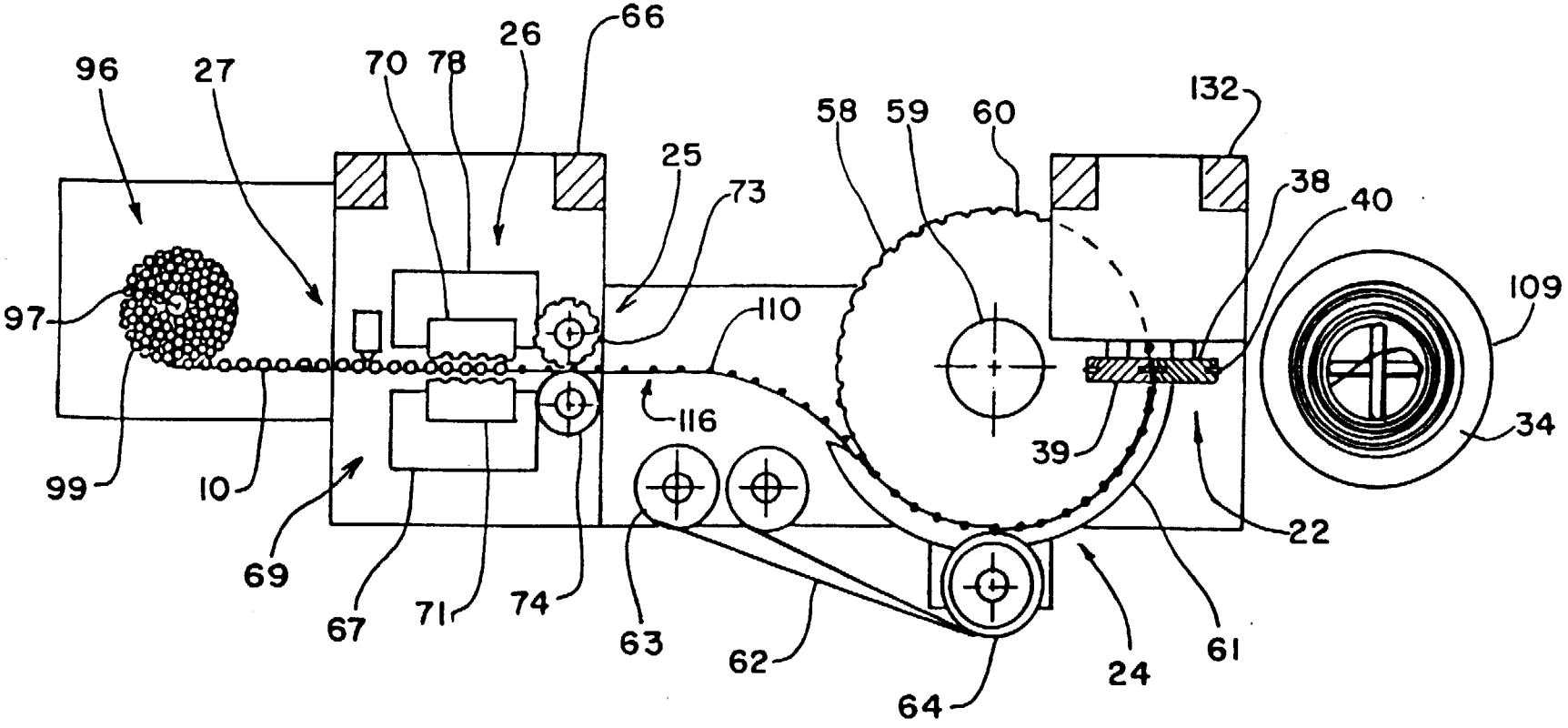
FIG. 4 is a top sectional view taken along line IV—IV of FIG. 3.

Referring to FIG. 3 and 4, the preferred embodiment of the present invention is illustrated. The wire 34 is stored on a carrier 109 disposed in the vicinity of the apparatus. The wire 34 is guided from the carrier 109 to the straightening guides 36 by way of pulleys 111 and 112. In operation, at least one strand of wire 34 enters set of wire straightening guides 36. The guides 36 straighten the wire 34 in the event that the wire is bent or twisted. It will be appreciated that because a large quantity of wire is used in a short period of time, the wire is usually supplied on very large spools or carriers 109.

Thus due to the loading and handling of the wire carriers 109, the wire 34 may become bent or twisted resulting in an unacceptable end product unless the wire 34 is straightened before a web 116 of headless fasteners 110 of the invention is formed. The wire straightening guides 36 may be of a standard commercial type that are available in a variety of shapes and sizes. In a preferred embodiment, there are two sets of wire straightening guides. The guides 36 are mounted on the vertical support frame 32, one set above the other, so that the wire 34 enters the first set of guides from above and passes between the first set of guides to the second set of guides mounted directly below. Although the guides are shown to have rollers and the sets are positioned at 90°, this is a matter of choice. The only requirement of the wire straightening guides 36 is that the wire 34 is straightened before the wire enters a feeding means 114 which is comprised of feed wheels 138 and 139. The feed wheels 138 and 139 are mounted on the vertical support frame 32 directly below the straightening guides 36 with the axis of each feed wheel 138 and 139 perpendicular to the path of the wire strand 34 and perpendicular to the plane formed by the vertical support frame 32. The gripping surface of the feed wheels 138 and 139 may be contoured to deform the exterior surface of the fastener shank 16 to provide increased holding power. The feed wheels 138 and 139 are positioned one on each side of the wire and engage against the wire 34 so as to prevent the wire from slipping from between the feed wheels. The wire 34, positioned between the pair of feed wheels 138 and 139, is then pulled through the straightening guides 36 by the rotation of the feed wheels. It will be appreciated that even if the gripping force of the feed wheels 138 and 139 were so great as to make a small flat on each side of the wire 34, the flat would have absolutely no effect on the process or the fastener thereby produced.

The wire 34 leaving the feeding wheels 138 and 139 passes through a guide 115 used to align the wire 34 with the headless fastener producing means 22, which severs the continuous wire 34 to produce headless fasteners 110. The preferred embodiment has the feeding wheels 138 and 139 and the headless fastener producing means 22 spaced a distance apart for convenient servicing and change over for various size fasteners. The guide 115 is located there between to direct the wire 34 in the correct position for cutting. The feeding means 114 and the cutting means 22 could of course be positioned much closer to each other and reduce the size of or eliminate the guide 115 completely.

The headless fastener producing means 22 is comprised of two wheels having parallel axis and at least one wire cutting means located on the circumference. The cutting wheels 38 and 39 have insets 40 that may be specifically spaced around the circumference of each wheel to correspond to the desired length of the particular type of headless fastener 110 to be produced. Each of the cutting wheels 38 and 39 has the exact same quantity and location of insets 40 and each of the cutting wheels 38 and 39 is interlocked with a gear train (not shown) to assure that each inset 40 on each cutting wheel 38 and 39 contacts on exactly opposite sides of the wire 34. Each inset 40 contains an edge 42 that is shaped to cut the wire 34 into individual headless fasteners 110 as the wire 34 passes thereby.

Because the insets 40 are positioned equally around the circumference of each cutting wheel 38 and 39, each headed fastener 10 produced is of a uniform length within certain prescribed manufacturing tolerances. The uniform positioning of the insets 40 about the circumference of the cutting wheels 38 and 39 achieves one important aspect of the invention, that being that the intermixing of odd size headed fasteners 10 in the assemblies 11 of fasteners is eliminated. It will be appreciated that by changing the spacing of the insets about the circumference of each wheel a different length of fastener may easily be produced.

The particular shape of the cutting edge 42 on the inset 40 corresponds to the type of workpiece entering end 18 that is desired on a particular headed fastener 10. A blunt workpiece entering end 18 of the headed fastener 10 may be formed by the pair of cutting wheels 38 and 39 wherein only one of the cutting wheels has insets 40 with a cutting edge 42 while the remaining wheel has a smooth surface without any insets.

The feeding and cutting means described is ideal when one length headed fastener 10 can be produced in very large quantities. In reality due to the many various sizes of fasteners required, the need to change from one length to another occurs quite often. Anticipating this situation, the preferred embodiment is designed to provide a peripheral velocity of the wire feeding wheels 138 and 139 less than that of the wire cutting wheels 38 and 39. This can be accomplished by fixing the speed of the headless fastener producing means 22 and controlling the speed of the feeding means 114 through a variable regulator (not shown). By reducing the peripheral velocity of the feed wheels 138 and 139, the length of the headless fastener is shortened. Likewise increasing the velocity will produce longer headless fasteners up to the maximum spacing between the cutting insets 40 in the cutting wheels 38 and 39. This system eliminates the downtime needed to change components compared to a system wherein both feeding means 114 and headless fastener producing means 22 have fixed speeds.

The individual headless fasteners 110 having been produced by the cutting wheels 38 and 39 must now be transferred onto the collating track 24 for collating the headless fasteners 110 in a spaced apart, parallel relationship. The collating track 24 in part comprises a rotatable gear 58 having slots 60 spaced along the outer periphery of the gear 58 corresponding to a predetermined spacing requirement for a particular assembly 11 of headed fasteners 10. The gear 58 is mounted on a shift 59 with the axis of the shaft positioned to allow the slots 60 to be parallel with the movement of the headless fasteners 110 as they are transferred from the headless fastener producing means 22 to the collating track 24.

The transfer means 123 can be as simple as a guide tube to direct the headless fasteners 110 into the slots 60 in the gear 58. For short headless fasteners this will work satisfactorily, but for longer fasteners 110 the preferred embodiment is to have the transfer means 123 include powered wheels 115. The wheels, one on each side of a headless fastener 110, have a peripheral speed considerably higher than that of the cutting wheels 38 and 39.

In order for the headless fastener 110 to be collated in the parallel relationship, the slots 60 in the gear 58 are preferred to be only slightly larger than the shank 16 of a particular fastener. The gear 58 thus stops during the time needed to introduce the headless fastener 110 into the slot 60. The headless fastener 110 does not have to be transferred a precise distance into the slot 60, but at least enough for stability. Since the time the gear 58 is stopped for the transfer affects the quantity of headed fasteners 10 produced per minute, the time used for transferring should be reduced as much as possible.

By having the transfer wheels 115 run at a higher speed than the headless fastener producing means 22, each individual headless fastener 110 can be transferred into a slot 60 and then the gear 58 indexes to the next position as each succeeding headless fastener 110 is being produced. The movements of the gear 58, headless fastener producing means 22 and transfer means 23 are driven by motor 30 through a synchronized drive train (not shown). The rotation of the cutting wheels 38, 39 and transfer wheels 115 are continuous whereas the rotation gear 58 has a high speed stutter step motion. It will be appreciated that although a rotating gear 58 is the preferred embodiment, the present invention may also utilize a toothed chain or track in place of the gear 58.

Figure 5:
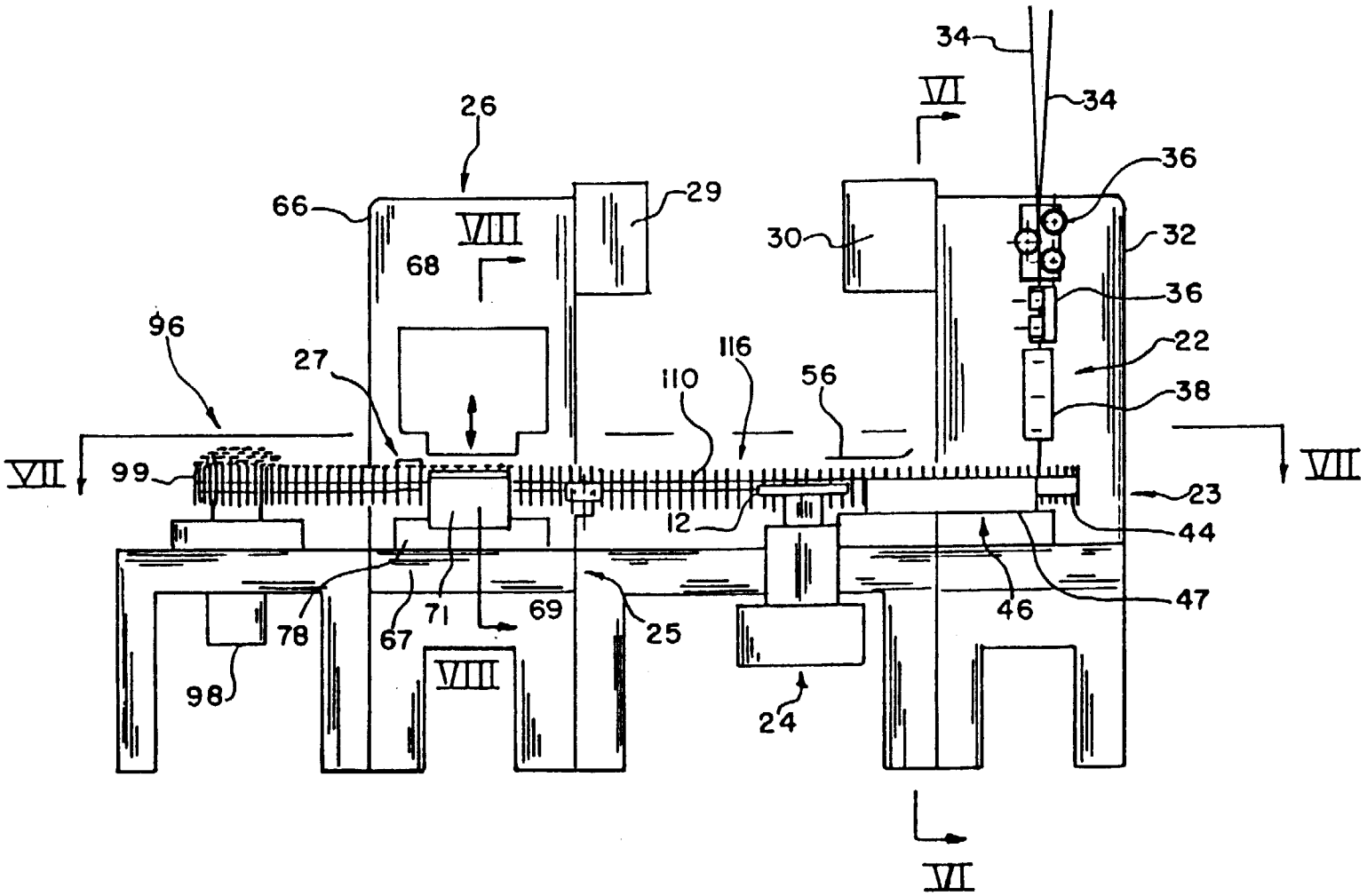
FIG. 5 is a side elevational view of an alternate apparatus used to form the assemblies of fasteners according to the present invention.
Figure 6:
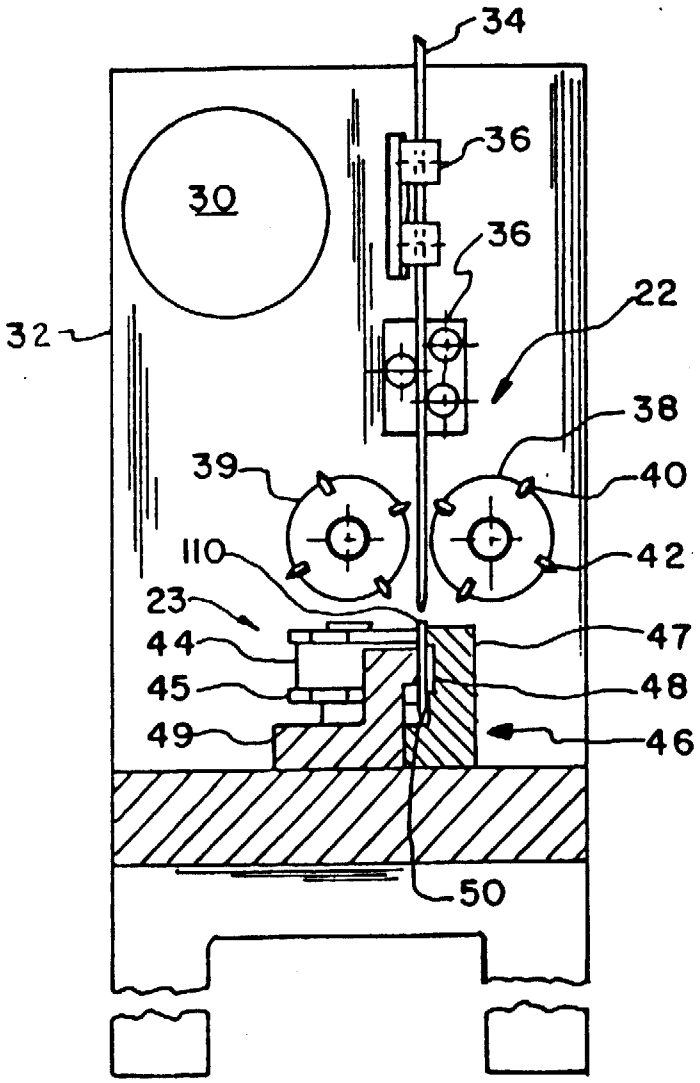
FIG. 6 is a cross-sectional view taken along line VI—VI of FIG. 5 illustrating the headless fastener producing device and the transfer device.
Figure 7:
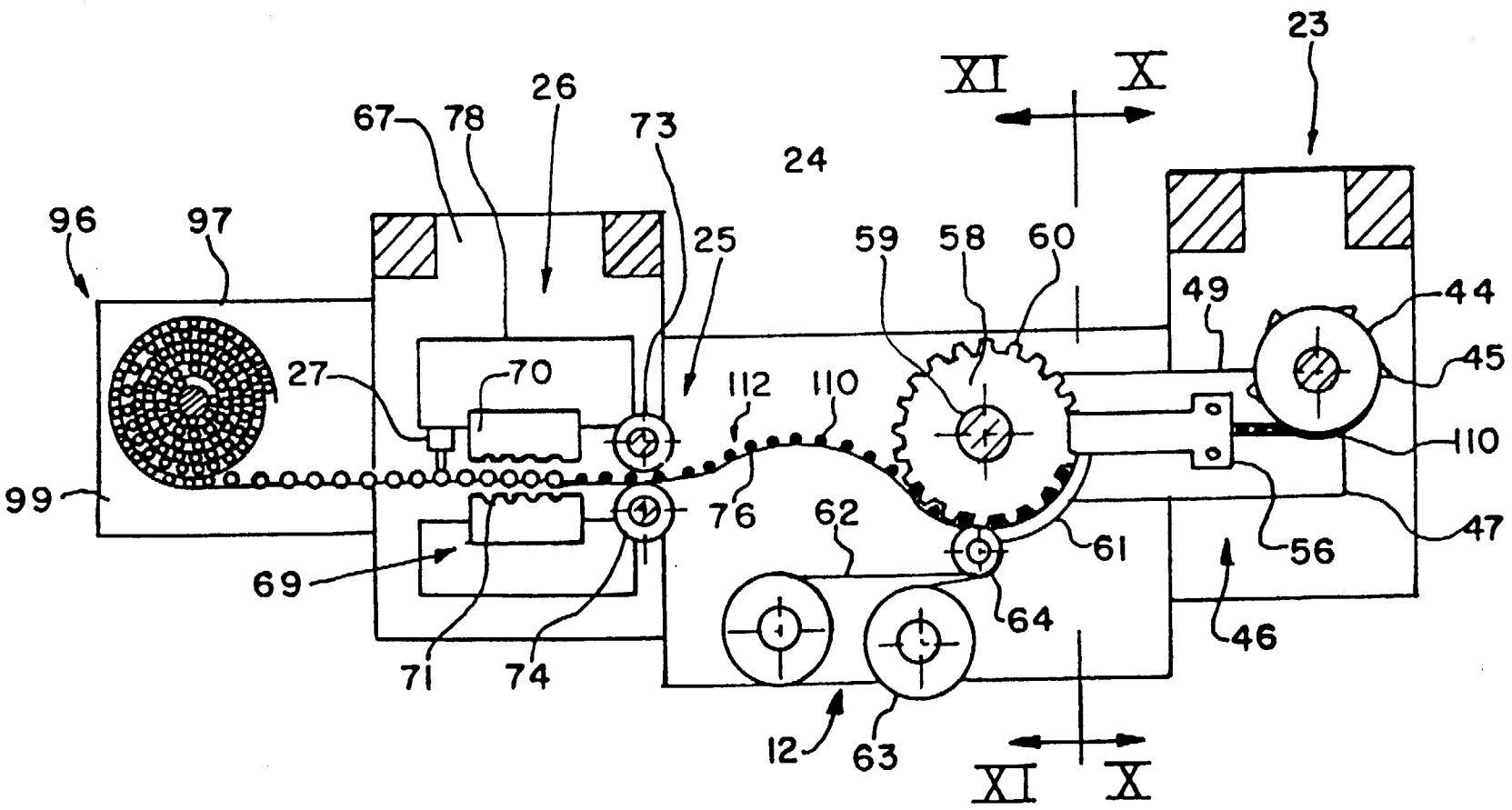
FIG. 7 is a top view taken along line VII—VII of FIG. 5.

FIG. 5, 6 and 7 disclose an alternate embodiment of the headless fastener producing and transferring means. The headless fastener producing means 22 is located immediately following the wire straightening guides 36 thus eliminating the feed wheels 138 and 139 and the guide 115. The cutting wheels 38 and 39 provide the feeding means as well as perform the headless fastener producing function. The cutting wheels 38 and 39, insets 40, cutting edges 42 and functional details are the same as previously described for a fixed length fastener. Since this alternate embodiment does not have a variable feeding means 114, the headless fasteners 110 will have the length determined by the spacing of the insets 40. To change fastener length, the cutting wheels 38 and 39 must be changed or the quantity of insets 40 must be altered.

As the wire 34 is cut by the cutting wheels 38 and 29 into individual headless fasteners 110 of uniform length, each headless fastener 110 drops away from the cutting wheels 38 and 29 to the transferring means 23 located directly below the cutting wheels 38 and 39. The transferring means 23 then conveys the headless fastener 110 to a guide track 46 prior to the next succeeding headless fastener 110 entering the transferring means 23. One embodiment for accomplishing the transfer of the headless fastener 110 is a rotating toothed wheel 44 whose axis is parallel to the path of the falling headless fastener 110 and that is in synchronization with the feed wheels 38 and 39 through the gear train (not shown). As each headless fastener 110 drops in front of a tooth 45 on the toothed wheel 44, the headless fastener 110 is rotated into the guide track 46 before the next headless fastener enters the toothed wheel 44. It will be appreciated that the toothed wheel 44 could be replaced by a conventional reciprocal motion pusher bar and accomplish the same result.

The guide track 46, perpendicular to the plane of the vertical support frame 32, accumulates the headless fasteners 110 in vertical adjacent alignment prior to their introduction into the collating track 24. The guide track 46, simple in construction, generally comprises a front rail 47, a recessed area 48, and a back rail 49. The front rail 47 is basically L-shaped and is used as a guide to keep the headless fasteners 110 in a straight line. The recessed area 48 is located in a central portion of the front rail 47 facing each headless fastener 110 and creates a small area of contact between the front rail 47 and the upper and lower portions of each headless fastener 110. The recessed area 48 serves to reduce the friction between the headless fasteners 110 and the front rail 47. The base 50 of the L-shaped front rail 47 extends under the headless fasteners 110 and allows the end of each headless fastener to rest upon the top of the base of the L-shaped front rail as the headless fasteners 110 are moved by the transferring means 23 along the guide track 46. The back rail 49 is located on the opposite side of the headless fasteners 110 directly opposing and spaced apart from the front rail 47. The space between the back rail 49 and front rail 47 permits the headless fasteners 110 to pass freely therebetween and yet maintain the fasteners in a vertical position. The back rail 49 is generally of a squared off z-shape with the top extension of the "z" extending toward the front rail 47 to support the fasteners in the vertical position.

The length of the guide track 46 is immaterial, but it is preferred that the length is held to a minimum in order to reduce the friction created by the headless fasteners 110 as they move along the guide track. Additionally, a guide track of shorter length lessens the opportunity for the headless fasteners 110 to become jammed between the front rail 47 and the back rail 49

A hold down bar 56 may be needed to keep the headless fasteners 110 against the top of the base 50 of the front rail 47. The hold down bar 56 may be a flat metal sheet overlapping a portion of the guide track 46 and the collating track 24. It will be appreciated that if the headless fasteners 110 raise as the headless fasteners move along the front rail 47, an irregular assembly 11 of fasteners is formed. The collating track 24 of the alternative embodiment is positioned at the exit end of the guide track 46 as a rotatable gear 58 mounted on a shaft 59 with the axis of the shaft perpendicular to the movement of the headless fasteners 110 as the headless fasteners are advanced along the guide track 46. The rotatable gear 58 has slots 60 spaced along the outer periphery of the gear corresponding to a predetermined spacing requirement for a particular assembly 11 of headed fasteners 110. The headless fasteners 110 are positioned in the guide track 46 in a vertical relationship as they advance toward the gear 58. The leading headless fastener 110 in the guide track 46 abuts the circumferential surface of the rotatable gear 58 as the gear rotates. When a slot 60 of the gear is aligned with the headless fastener 110, the leading headless fastener enters the slot while the next headless fastener advances to and abuts the rotatable gear 58 awaiting the next slot. It will be appreciated that the movement of the headless fastener 110 into the slots 60 may be assisted by vibrating the guide track 46. At high production speeds, approaching 50 headless fasteners 110 per second, the need for vibration increases in order to facilitate in the steady and efficient production of the continuous web 116 of headless fasteners 110.

In both embodiments, the headless fasteners 110 are tightly seated in the slots 60 by a retaining bar 61 spaced apart from and positioned around a portion of the circumference of the rotatable gear 58. The retaining bar 61 ensures the headless fasteners come into contact with the collating material 12, 21 at the required spaced-apart distance determined by the slot spacing of the gear 58 to form the continuous web 116 of the headless fasteners 110.

One type of collating material utilized is a strand of wire 62 electrowelded tangentially to the shank of each headless fastener 110. A spool 63 of the wire 62 is positioned in a convenient location for loading and unloading as the wire is used. The wire 62 is conveyed from the spool 63, around an electrode 64 and then pressed against a headless fastener held within a slot 60 in the gear 58 by the electrode 64. The electrode 64 is then subjected to an electrical impulse. The contacting surfaces of the wire 62 and the headless fastener within the gear 58 are welded together by the heat generated by the electrical impulse. The rotatable gear 58 repeatedly brings each succeeding headless fastener 11 held within the slot 60 against the wire 62 and along side the electrode 64. As the wire 62 is pressed against the shank of the next succeeding headless fastener 110 by the electrode 64 and rotating gear 58, the electrical impulse welds the wire to the shank of each headless fastener to form the web of fasteners. As the continuous web 116 of headless fasteners 110 is formed, wire 62 is constantly pulled from the spool 63 by the motion of the wire welded headless fasteners away from the spool 63. To reduce wear and friction, it is preferred to have the electrode 64 constructed as a roller mounted on a shaft with the axis of the roller parallel to the axis of the rotating gear 58 and positioned against the wire 62 that is to be welded to the headless fasteners located within the slots 60 in the outer periphery of the rotating gear 58.

In a preferred embodiment, two parallel wires 62 are welded on the same side of each headless fastener 110 as illustrated in FIGS. 1, 3 and 5. The two parallel wires assure that the headless fasteners 110 are maintained in a fixed, equally spaced-apart parallel relationship.

In another embodiment of the invention in which assemblies 11 of headed fasteners 110 are produced for tools that require an assembly of equally spaced-apart parallel fasteners, the collating material 12 may be a molded plastic. The previously described electrode 64 may take the form of a set of plastic forming rollers and the previously described electrical impulse welder may take the form of a molded plastic extruder.

The molded plastic is normally applied around the headless fastener in a heated condition. After bonding to the headless fastener, the plastic is allowed to cool resulting in a more rigid web 116 than the web produced with the metallic wire as previously described.

In yet another embodiment of the invention, the collating material 21 may be a preshaped plastic strip with griping sections spaced on the plastic strip to match the spacing of the slots 60 in the rotating gear 58. The electrode 64 may take a form of a pressure roller that forces the gripping section against the headless fastener 110 thus affixing the headless fastener 110 to the plastic strip.

It should be noted that certain fastening applications require the fastener magazine of the fastener driving tool to be positioned at a distance from the workpiece. A distal fastener magazine provides clearance between the driving tool and the workpiece thereby making handling of the tool much easier. A distal fastener magazine necessitates that the plane formed by the ends of the collated headed fasteners 10 of the assembly 11' is angled or positioned in a nonperpendicular relationship to their shanks 16. The shanks 16 remain in a parallel relation to one another as shown in FIG. 1. The angle of the plane from horizontal is generally between 15° to 35° depending upon the style of tool in which the headed fasteners 110 are used.

Figure 10:
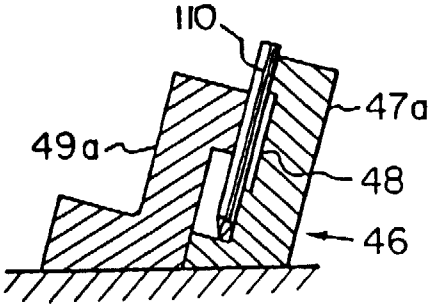
FIG. 10 is a partial cross-sectional view of a guide track for angled headless fasteners of the type shown in FIG. 2 taken along line X—X of FIG. 7.
Figure 11:
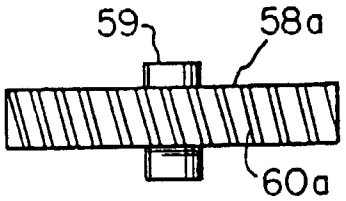
FIG. 11 is a partial cross-sectional view of a collating gear for angled headless fasteners taken along line XI—XI of FIG. 7.

The present invention can be easily adapted to produce various fastener magazine configurations for various types of tools. As shown in FIGS. 10 and 11 the exit section of the guide track 46 may be gradually tilted from vertical to the desired angle from horizontal. The bottom surfaces of front rail 47a and back rail 49a are constructed to position the headless fastener therebetween at the correct angle. The relationship of the recessed area 48 and base 50 remains substantially the same as previously described. The rotatable gear 58a includes slots 60a along the outer periphery of the gear corresponding to the predetermined spacing and angle requirements for a particular assembly of fasteners. The leading headless fastener 110 in the guide track 46 enters the slot and is collated as previously described herein. In the preferred embodiment of introducing the headless fastener 110 directly into the rotatable gear 58, the headless fastener producing means 22 and transfer means 123 is tilted from the vertical to correspond to and align with the slots 60a in gear 58a. Whichever collating material 12 or 21 and method are employed, a web 116 of headed fasteners 110 is formed by the use of a collating material secured to a series of headless fasteners.

To produce an assembly 11 of headed fasteners 10 from the continuous web 116 of headless fasteners 110, the web 116 is fed into the head-forming means 26 by conveying means 25. The head-forming means 26, as illustrated in FIGS. 3-9, comprises a support frame 66 and a reciprocal ram 68 that is powered through a cam (not shown) by an electric motor 29. The support frame 66 has a horizontal base portion 67 upon which is mounted the clamping block 69 having two half portions 70 and 71. The clamping block halves 70 and 71 hold the headless fasteners 110 therebetween in a fixed position during the formation of the head 14 of the fasteners. At least one and preferably two or more fastener heads are formed on each stroke of the ram 68. However, the quantity of headless fasteners 110 that are headed on each stroke of the ram 68 may depend upon the shape of the head 14 to be formed and the diameter of the wire 34 that is used to produce the headed fasteners 10. For example, a ram with a 5 horsepower electric motor can form 10 heads per stroke on wire fasteners of 1.2 mm. diameter. With 2.0 mm diameter wire, the quantity of heads that may be formed is reduced to 5 heads per stroke unless the overall size of the ram is increased to accommodate approximately 10 heads per stroke. For fasteners having shank diameter over 2.0 mm, the quantity may be reduced to 2 heads per stroke.

The conveyor 25 comprises a pair of rollers 73 and contact with the continuous web 116 of headless fasteners 110 with the axes of the rollers 73 and 74 perpendicular to the direction of movement of the web 116. On each upward stroke of the reciprocal ram 68 the rollers 73 and 74 are rotated to advance a portion of the web 116 of headless fasteners 110 between the clamping block halves 70 and 71 to be headed on the next downward movement of the ram 68. It should be understood that a linkage (not shown) supplies power to the conveying rollers 73 and 74 and is of a type that is commercially available and is not a limitation to the practice of the present invention. Furthermore, the conveying linkage (not shown) is normally adjusted to provide a movement of the circumferential surface of the conveying rollers 73 and 74 that corresponds to the length of the assembly of headless fasteners 110 that are to be headed between the clamping block halves 70 and 71. During the formation of the heads 14, the continuous web 116 may form a bend 76, in relation to a line between the rotatable gear 58 and the conveying rollers 73 and 74. The size of the web bend increases as the continuous web 116 of headless fasteners continues to exit from the rotatable gear 58 and the portion of the web 116 of headless fasteners between the rollers 73 and 67 is stationary. Accordingly, the conveying rollers 73 and 74 may feed the web 116 of headless fasteners to the clamping block 69 intermittently without restriction from the process within the collating means 24.

Figure 8:
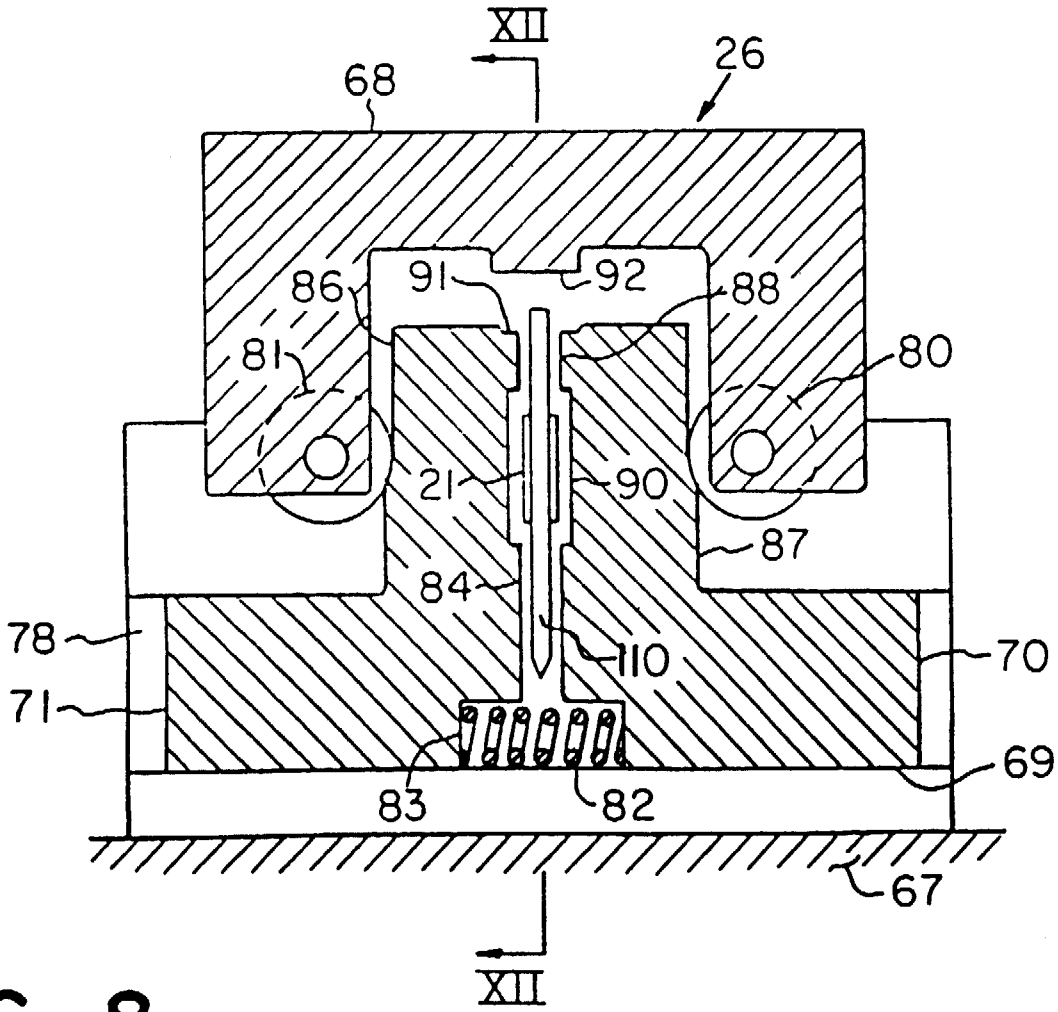
FIG. 8 is a cross-sectional view of a head-forming device in its open position taken along line VIII—VIII of FIG. 5.
Figure 9:
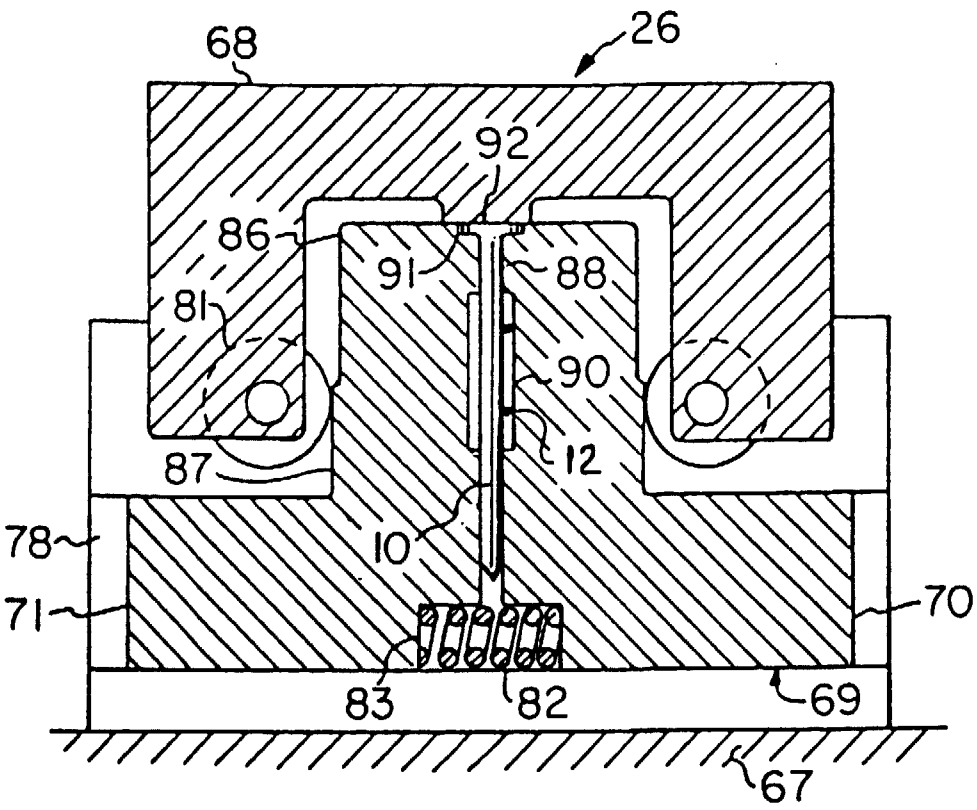
FIG. 9 is a cross-sectional view of the head-forming device in its closed position.

Referring now the FIGS. 8 and 9, one embodiment of the clamping block 69 is illustrated that generally comprises two halves 70 and 71 symmetrically located about the centerline of the clamping block 69. A guide block 78 is mounted on the horizontal base portion 67 of the frame and restrains the movement of the clamping block halves 70 and 71. The clamping block halves 70 and 71 are movable within the guide block 78 perpendicular to the movement of the continuous web 116 of headless fasteners 110 as the headless fasteners pass between the two halves 70 and 71 of the clamping block 69. The clamping block halves 70 and 71 are L-shaped with the extended vertical member of each L-shaped half aligned against a portion of the collated headless fasteners 110 that are located therebetween.

The reciprocal ram 68 of the head-forming means 26 is in the shape of an inverted "U" and fits over the upwardly extending vertical portions of each L-shaped halves 70 and 71 of the clamping block 69. Each appendage of the inverted "U" has attached to the end thereof ram rollers 80 and 81. A compression spring 82 is positioned within a channel 83 formed in the bottom of each half 70 and 71 of the clamping block 69. The spring 82 forces each half 70 and 71 of the clamping block away from the centerline of the clamping block 69 and against the guide block 78 and ram rollers 80 and 81 attached to each appendage of the inverted "U" to provide a space wide enough to allow the continuous web 116 to pass freely therebetween.

In operation, a portion of the continuous web 116 of headless fasteners 110 is conveyed between the clamping block halves 70 and 71 by the conveyor 25 when the clamping block halves are spaced apart. A first outer surface 86 of each half 70 and 71 of the clamping block 69 is in contact with the ram rollers 80 and 81, and acts as a stop to provide the space 84 when the clamping block halves 70 and 71 are forced apart against the ram rollers. As the ram rollers 80 and 81 begin to move downward over the exterior vertical surface of the L-shaped clamping block halves, the ram rollers contact a second protruding outer surface 87 of each half 70 and 71 of the clamping block 69. Because the second surface 87 extends further from the centerline of the clamping block 69 than the first surface 86, the clamping block halves 70 and 71 are forced toward the centerline of the clamping block 69 as the ram rollers 80 and 81 ride onto the second surface 87. As the clamping block halves 70 and 71 are forced toward the centerline, the continuous web 116 of headless fasteners 110 is clasped tightly by the inside surface 88 of each half 70 and 7 of the clamping block 69. The clamping block 69 is now in the closed position. A first recess 90 is provided in the inwardly facing surface of each L-shaped half 70 and 71 of the clamping block 69 to provide clearance space for the collating material, which is shown in FIG. 8 as strip 21 and as two strands of wire 12 welded to the fastener in FIG. 9. In FIGS. 8 and 9, a second recess 91 is provided in the top inside edge of each L-shaped half 70 and 71 of the clamping block 69 to correspond to the shape of the underside of the head 14 to be formed. It will be appreciated that the recess 91 may be in a variety of shapes and sizes to form different type nail heads. For example, the recess may be circular in configuration to produce the round head nail. As the ram 68 and ram rollers 80 and 81 continue to move downward over the second surface 87, the clamping block halves 70 and 71 remain stationary against the shank of the fasteners clasped therebetween because the plane of the second surface is parallel to the movement of the ram.

A downwardly protruding center portion 92 of the ram, positioned directly over top of the section of headless fasteners 110 within the clamping block 69, is used as a punch to deform the upper end of each headless fastener 110 into the shape of the second recess 91 resulting in the fastener head 14. After the ram 68 has completed its downward movement and formed the fastener end into the shape of the second recess 91, the ram 68 returns upward. As the ram 68 moves upward, the ram rollers 80 and 81 move off the second outer surface 87. The spring 82 located in the channel 83 at the bottom of the clamping block 69, acts against each half 70 and 71 of the clamping block 69 and forces the clamping block halves apart and away from the centerline of the clamping block until the ram rollers 80 and 81 again contact the first surface 86. The clamping block 69 is now in the open position. Although FIGS. 8 and 9 illustrate a symmetrical set of clamping block halves 70 and 71, ram rollers 80 and 81, surfaces 86, 87, and recesses 90 and 91, it should be obvious that other means of moving the clamping block halves so as to form the head 14 of the fasteners may work equally as well.

Figure 12:
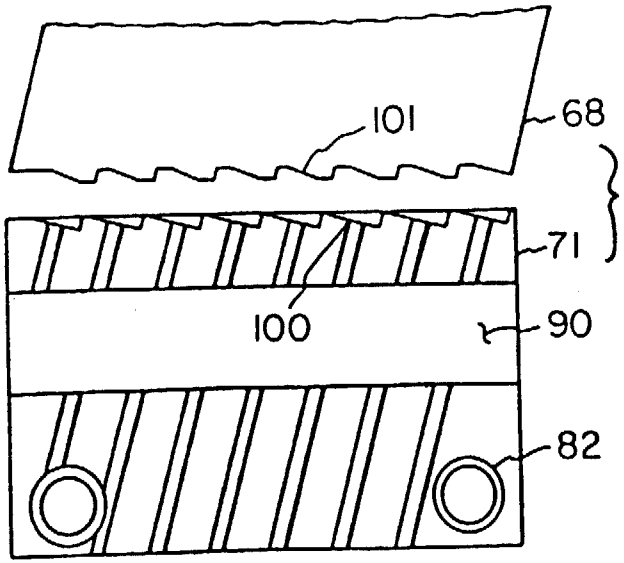
FIG. 12 is a partial cross-sectional view of a head-forming device for angled headless fasteners taken along line XII—XII of FIG. 8.

An apparatus to form assemblies 11' of angled headed fasteners 110 is shown in FIG. 12. The upper surface of clamping block halves 70 and 71 each contain a plurality of inclined recesses 100. When the halve 70 and 71 are in a clamped position, the head 14 is formed symmetrical to the shank 16 by ram 68. The ram 68 is formed of a center portion 101 shaped to mate with the inclined recesses 100 to form the desired head configuration. The preferred movement of the ram 68 to form the angled fastener assembly is parallel to the angled shank 16 rather than perpendicular to the web feeding direction as previously described.

After the punch forms the head 14 on each headless fasteners 110 of the assembly of fasteners, the assembly is in the form of a headed assembly of fasteners. The web 116 of headed fasteners 11 is forced out of the head-forming means 26 by the conveyor 25 advancing the next section of headless fasteners 110 into the clamping block halves 70 and 71.

Figure 13:
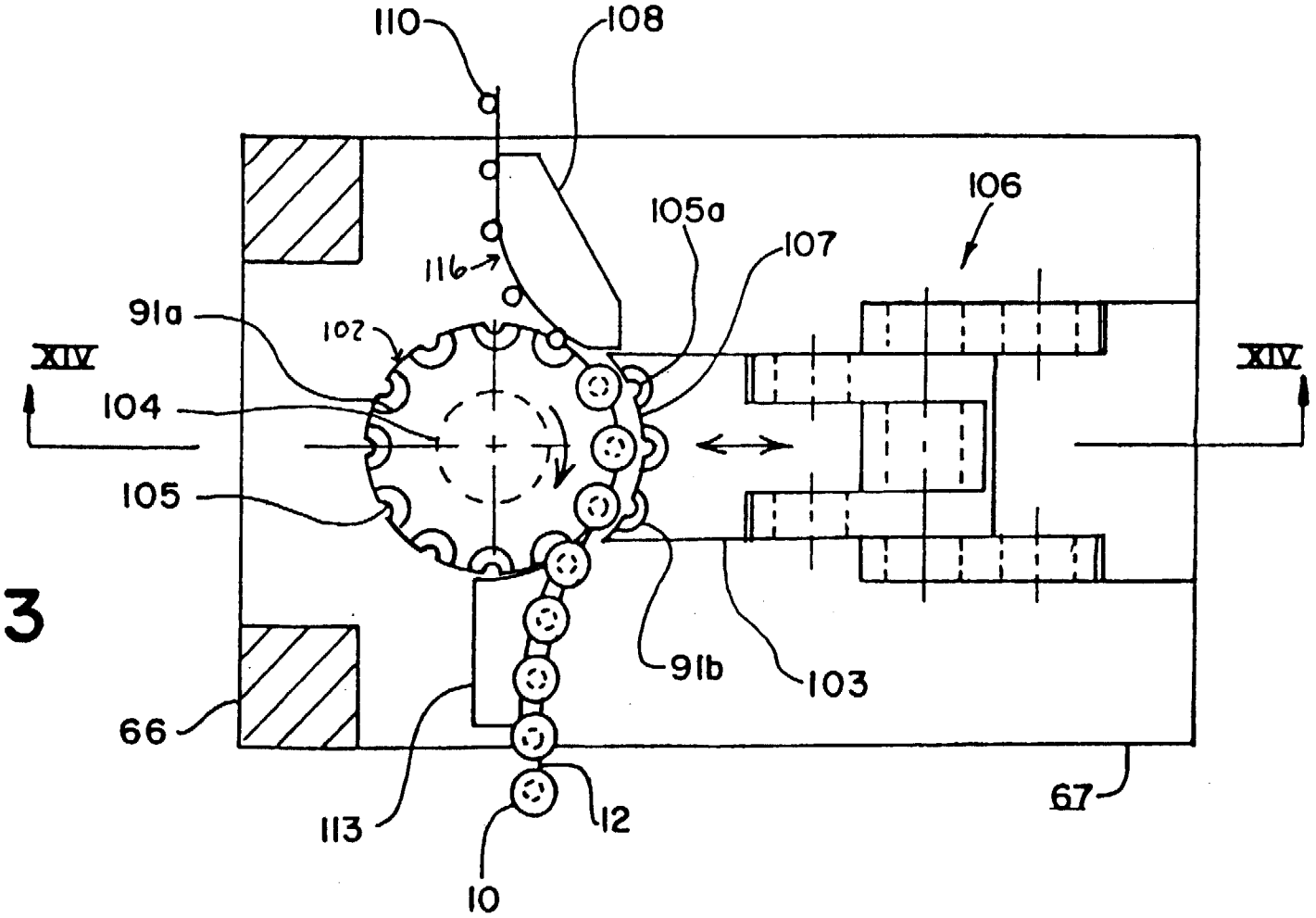
FIG. 13 is a partial top view of an alternate conveying and head-forming device.
Figure 14:
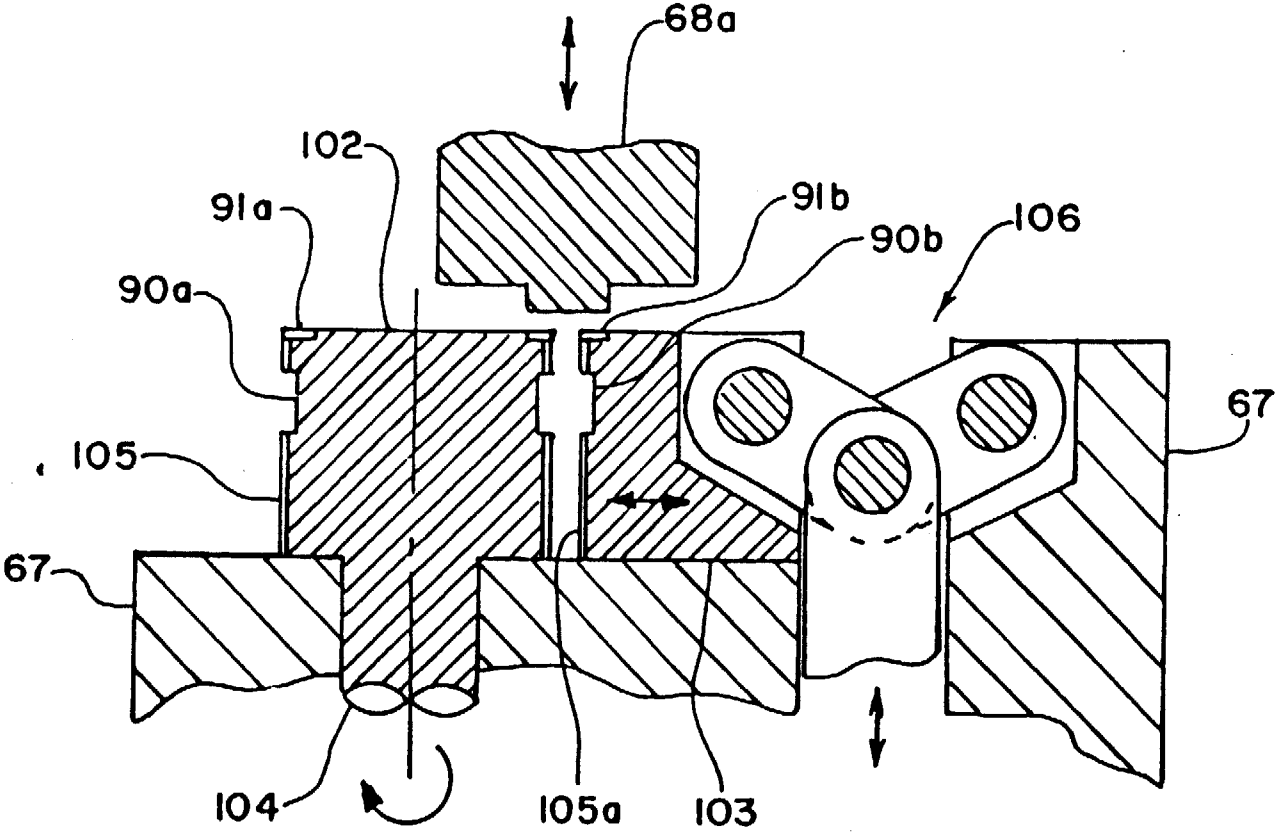
FIG. 14 is a partial cross-sectional view of the clamping and head-forming device taken along line XIV—XIV of FIG. 13.

An alternate embodiment to form the head 14 of the fastener 10 is illustrated in FIGS. 13 and 14. This embodiment is preferred whenever the headless fasteners 110 are held at angle with respect to their web 116 to produce assemblies 11' as shown in FIG. 1. The alternate embodiment combines the conveying and head-forming into one means comprising in part of a rotatable gear 102, a clamping block 103, a head-forming ram 68 and a means to cause movement of each.

A rotatable gear 102 is mounted on a vertical shaft 104 located in the horizontal base portion 67 of the head-forming frame 66. The gear 102 has spaced apart slots 105 on its periphery to correspond to the fastener spacing of the assembly of fasteners to be produced. The upper side of the gear 102 has a recesses **91*a* symmetrical about slot 104 to form one portion of the fastener head 14 when the headless fasteners 110 are struck by the ram 68**.

The clamping block 103 is mounted on the base portion 67 and is moved in a reciprocal cycle perpendicular to shaft 104 by a linkage means 106. The block 103 has a concave surface 107 to correspond in shape to the peripheral surface of the rotating gear 102. Within the surface 107 of the clamping block 103 are slots **105*a* spaced to align with slots 105 in gear 102, whenever clamping block 103 is in the fastener clamping position relationship with gear 102**.

The upper surface of clamping block 103 has a recess **91*b* symmetrical about slot 105*a* to form one portion of the fastener head 14. The recess 91*b* is located vertically to be on the same horizontal plane as that of recess 91*a* in gear 102. When clamping block 103 and gear 102 are in a fastener clamping position, the recesses 91*a* and 91*b* determine the size and shape of the fastener head 14. The gear 102 may have a peripheral recess 90*a* intermediate the upper and lower surfaces to provide clearance for the collating material 12 or 21. The surface 107 may likewise have a recess 90*b*** for the same purpose.

The sequential operation of this alternate embodiment is to have a portion of the continuous web 116 of headless fasteners 110 positioned in at least two of the slots 105 in the rotatable gear 102 as the ram 68 begins its downward stroke. Prior to the ram 68 striking the headless fastener 110, the linkage means 106 moves the clamping block 103 toward the rotatable gear 102 providing a clamping engagement with the headless fasteners 110 positioned therebetween sufficient to keep the headless fasteners 110 from slipping as the fastener heads 14 are formed by the ram 68. After the ram 68 has made the full head-forming stroke, the ram 68 returns to its open position.

When the ram 68 has sufficiently cleared the gear 102 and block 103, the linkage moves the clamping block 103 away from the rotatable gear 102. The shaft 103 is rotated a precise amount to advance the quantity of slots 105 corresponding to the number of fastener heads 14 formed by the ram 68 during the head-forming stroke. As the gear 102 moves the headed fasteners 10 from the head-forming area, the subsequent headless fasteners 110 in the continuous web 116 are moved into position to have heads 14 formed by the next cycle of the ram 68. The movement of the ram 68, rotatable gear 102, clamping block 103 and linkage means 106 are all synchronized by a drive train (not shown) powered by motor 29. The head-forming means 26 thus functions in continuous repetitive cycles.

To assure the web 116 of fasteners remains in proper engagement with the slots 105 in the gear 102 during the time the clamping block 103 is not engaged, a guide plate 108 is abutted the gear 102 at the entry to secure the headless fasteners 110 seat in the slots 105. After the heads 14 are formed, the headed fasteners 10 may fit tightly in the slots 105 and recess **91*a* and not exit easily as gear 102 moves to the next position. To facilitate the extraction of the fastener 10 from the slots 105, a tapered strip 113 may be mounted on the base 67 with the leading portion resting in recess 90*a* to pry the fastener 10 out of the slot 102 as the fasteners 10** pass thereby.

A measuring or counting device (not shown) is used to actuate the severing means 27 to cut the web 116 of headed fasteners 10 to a selected length or quantity of fasteners 10 to form the strips or assemblies 11 of headed fasteners. If the required length or quantity of fasteners is to be used in a tool requiring the fastener to be in a coiled form, a coiling device 96 may be used. Several types of coiling devices are readily available. FIGS. 3 and 7 disclose one type of coiling device. The coiling device disclosed operates by connecting the leading end of the continuous web 116 of fasteners onto a hook which is mounted o a vertical rotating shaft 97. A motor 98 rotates the shaft 97 and pulls the web 116 to form a coiled assembly 99. The severing means 27 then cuts the web 116 to the selected length or quantity of fasteners 10. The coiled assembly 99 is then removed and the leading end of the next fastener assembly is hooked onto the vertical rotating shaft 97.

It should be noted that the coiling device 96 would not be used when producing an assembly 11 of fasteners 10 to be used in a tool that requires fasteners in strip form as opposed to coiled form. It will be appreciated that the various embodiments of the invention which have been illustrated and described as including a vertically standing framework may also include an inclined or tilted framework at 90° or at any degree therebetween and perform equally as well. The orientation of all of the components or movements previously referred to herein would be suitably adjusted to compensate for the alignment of the framework.

Having described presently the preferred embodiments of the invention, it is to be understood that the invention may be otherwise embodied within the scope of the appended claims.

I claim:

1. A process for machining a strand of wire to provide assemblies of a selected number of headed fasteners, said process carried out at a first workstation and a second workstation, said process comprising the steps of:

(a) cutting the strand of wire into headless fasteners of a selected, uniform length;

(b) transferring the headless fasteners to the first workstation;

(c) at the first workstation, aligning the headless fasteners in a spaced, parallel relationship to each other and then collating the headless fasteners to form a continuous web of the headless fasteners;

(d) conveying the continuous web of collated headless fasteners from the first workstation to the second workstation;

(e) at the second workstation, forming a head on one end of the fasteners of the continuous web when the fasteners are disposed at the second workstation; and (f) conveying the continuous web from the second workstation and selectively severing the continuous web of headed fasteners to provide the assemblies of the selected number of headed fasteners.

2. The machining process as claimed in claim 1, further comprising the steps of securing a leading end of the continuous web to a rotating shaft, and rotating the shaft to form a coiled assembly of the selected number of fasteners.

3. The machining process as claimed in claim 1, wherein each headless fastener cut from the strand of wire has a shank and opposing first and second ends, the headless fasteners are aligned such that their opposing first and second ends are disposed in corresponding lines, and the aligned fasteners are collated into the continuous web such that the angle between the shank of each fastener and the first and second lines is less than 90°.

4. Apparatus for receiving at least a single strand of wire and producing therefrom assemblies of a selected number of headed fasteners, said apparatus comprising:

(a) means for cutting the single strand of wire into headless fasteners of a selected, uniform length;

(b) means for receiving and aligning the headless fasteners in a parallel alignment with each other;

(c) means for collating the parallel, aligned headless fasteners to form a continuous web of the parallel, aligned headless fasteners;

(d) conveying and forming means disposed downstream of said collating means for conveying from said collating means the continuous web of headless fasteners in a direction of movement to said conveying and forming means, and for forming a head on one end of each of the headless fasteners; and (e) means disposed downstream of said forming means for receiving the continuous web of headed fasteners and for severing the continuous web to provide therefrom the assemblies of the selected number of headed fasteners.

5. The apparatus for continuously producing assemblies of headed fasteners as claimed in claim 4, wherein each headless fastener cut by said cutting means has a shank and opposing first and second ends, said aligning means aligning the cut headless fasteners such that their opposing first and second ends are disposed in corresponding first and second lines, and said collating means collating the continuous web of headless fasteners such that the angle between the shank of each headless fastener of the web and the first and second lines is less than 90°.

6. The apparatus for continuously producing assemblies of headed fasteners as set forth in claim 4, wherein said aligning means comprises a track having spaced apart slots thereon, said slots being selectively and regularly positioned to allow the cut headless fasteners to be transferred directly from said cutting means into said slots as the headless fasteners exit said cutting means, said slots holding said headless fasteners therein.

7. The apparatus for continuously producing assemblies of headed fasteners as set forth in claim 6, wherein said collating means applies a non-metallic strip to that headless fastener while held within said slots of said track, said strip having on one side thereof a heat activated adhesive for the purpose of adhering said strip to the headless fastener.

8. The apparatus for continuously producing assemblies of headed fasteners as set forth in claim 6, wherein said collating means comprises means for feeding a wire strand to the headless fasteners while held within said slots of said track, and an electrode disposed adjacent said track to contact and dispose the wire strand against the headless fasteners while held within said slots of said track, said electrode applying an electrical impulse of sufficient magnitude to weld the wire strand to the exiting headless fasteners resulting in the formation of the continuous web of headless fasteners.

9. The apparatus for continuously producing assemblies of headed fasteners as set forth in claim 8, wherein said feeding means feeds at least two metallic wires to the headless fasteners while held within said slot of said track, whereby said electrode welds the two metallic wires in a spaced apart arrangement on the same side of each headless fastener.

10. The apparatus for continuously producing assemblies of headed fasteners as set forth in claim 6, wherein said collating means comprises means for dispensing a collating material onto the headless fasteners while held within said slots of said track, and a set of forming rollers disposed on opposing sides of the headless fasteners moving said web in a given direction, each roller of said set having an axis perpendicular to said given direction, said set of rollers forcing said collating material about the headless fasteners as they and the collating material pass therebetween resulting in the formation of the continuous web of headless fasteners.

11. The apparatus for continuously producing assemblies of headed fasteners as set forth in claim 10, wherein said dispensing means feeds a unitary strip of plastic material into contact with the headless fasteners while held within said slots of said track.

12. The apparatus for continuously producing assemblies of headed fasteners as set forth in claim 10, wherein said dispensing means feeds two spaced apart parallel strips formed into contact with the headless fasteners while held within said slots of said track.

13. The apparatus for continuously producing assemblies of headed fasteners as set forth in claim 6, wherein said track pauses briefly during the transfer of the cut headless fasteners from said cutting means into said slots of said track.

14. The apparatus for continuously producing assemblies of headed fasteners as set forth in claim 13, wherein said track further comprises a rotatable gear having said spaced apart slots on the periphery of said rotatable gear.

15. The apparatus for continuously producing assemblies of headed fasteners as set forth in claim 4, wherein said aligning means comprises a set of powered rollers positioned on opposite side of and in frictional contact with the cut headless fasteners, and said set of powered rollers increasing the velocity of each cut fastener exiting said cutting means, said aligning means comprising a track having spaced apart slots thereon, said slots being selectively and regularly positioned to allow the cut headless fasteners to be transferred directly from said set of powered rollers into said slots.

16. The apparatus for continuously producing assemblies of headed fasteners as set forth in claim 15, wherein said track pauses briefly during the transfer of the cut headless fastener from said cutting means into one of said slots.

17. The apparatus for continuously producing assemblies of headed fasteners as set forth in claim 16, wherein said track further comprises a rotatable gear having said spaced apart slots on the periphery of said rotatable gear.

18. The apparatus for continuously producing assemblies of headed fasteners as set forth in claim 4, wherein said collating means comprises means for dispensing a collating material into the headless fasteners, and a pressure wheel forcibly disposed against that headless fastener while held within said slots of said track, whereby the collating material is forced adjacent and attaches to a portion of that held headless fastener to thereby produce the continuous web of headless fasteners.

19. The apparatus for continuously producing assemblies of headed fasteners as set forth in claim 4, wherein said conveying and head-forming means comprises a clamping device disposed to receive the continuous web of headless fasteners for clamping at least two headless fasteners of the continuous web therein, and a reciprocal ram, said clamping device firmly holding the two headless fasteners therein as said reciprocal ram strikes an end of the fasteners resulting in the formation of headed fasteners.

20. The apparatus for continuously producing assemblies of headed fasteners as set forth in claim 19, wherein said conveying and head-forming means comprises a rotatable gear for engaging at least two headless fasteners of the continuous web and having an axis perpendicular to the direction of movement of the continuous web, said clamping device having reciprocal movement perpendicular to said axis of said rotatable gear, said rotatable gear advancing the two headless fasteners as said rotatable gear rotates on said axis, said clamping device and said rotatable gear firmly holding the two fasteners therebetween as said reciprocal ram strikes an end of the two fasteners resulting in the formation of headed fasteners.

21. The apparatus for continuously producing assemblies of fasteners as set forth in claim 19, wherein said reciprocal ram forms the head of the fasteners in a generally circular shape.

* * * * *